US011333035B2

(12) United States Patent
Ahmad et al.

(10) Patent No.: US 11,333,035 B2
(45) Date of Patent: May 17, 2022

(54) SHAFT SHEAR DETECTION IN A GAS TURBINE ENGINE

(71) Applicant: PRATT & WHITNEY CANADA CORP., Longueuil (CA)

(72) Inventors: Zubair Ahmad, Toronto (CA); Andrew Roach, Brampton (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 127 days.

(21) Appl. No.: 16/521,081

(22) Filed: Jul. 24, 2019

(65) Prior Publication Data

US 2021/0025287 A1 Jan. 28, 2021

(51) Int. Cl.

| | |
|---|---|
| ***F01D 21/00*** | (2006.01) |
| ***F01D 25/00*** | (2006.01) |
| ***G08B 21/18*** | (2006.01) |
| ***F01D 21/04*** | (2006.01) |

(52) U.S. Cl.

CPC ..... *F01D 21/003* (2013.01); *F01D 21/04* (2013.01); *F01D 25/00* (2013.01); *G08B 21/182* (2013.01); *F05D 2220/32* (2013.01); *F05D 2240/60* (2013.01); *F05D 2260/80* (2013.01)

(58) Field of Classification Search

None

See application file for complete search history.

(56) References Cited

U.S. PATENT DOCUMENTS

| | | | | |
|---|---|---|---|---|
| 5,234,315 | A | 8/1993 | Ogihara et al. | |
| 5,293,774 | A | 3/1994 | Ratherham | |
| 5,363,317 | A | 11/1994 | Rice et al. | |
| 6,293,085 | B2 | 9/2001 | Thompson et al. | |
| 6,494,046 | B1 * | 12/2002 | Hayess | F01D 21/00 60/39.091 |
| 8,172,509 | B2 | 5/2012 | Bart et al. | |
| 8,943,876 | B2 | 2/2015 | Rowe et al. | |
| 9,410,444 | B2 * | 8/2016 | Bacic | F01D 17/085 |
| 10,167,784 | B2 * | 1/2019 | Dooley | F02C 9/46 |
| 10,180,078 | B2 | 1/2019 | Roach et al. | |
| 10,190,440 | B2 | 1/2019 | Argote et al. | |
| 2012/0210694 | A1 | 8/2012 | Holmquist | |
| 2013/0098042 | A1 | 4/2013 | Frealle et al. | |
| 2013/0133333 | A1 | 5/2013 | Bacic | |
| 2013/0152600 | A1 | 6/2013 | Rowe | |
| 2014/0121934 | A1 * | 5/2014 | Dooley | F01D 21/06 701/100 |
| 2016/0363001 | A1 * | 12/2016 | Argote | F01D 21/003 |
| 2018/0045071 | A1 * | 2/2018 | Roach | F01D 21/003 |

FOREIGN PATENT DOCUMENTS

| | | | |
|---|---|---|---|
| EP | 2588718 | B1 | 11/2017 |
| FR | 2921974 | A1 | 4/2009 |

* cited by examiner

*Primary Examiner* — Juan G Flores

(74) *Attorney, Agent, or Firm* — Norton Rose Fulbright Canada LLP

(57) ABSTRACT

A shaft event is detected, such as a shaft shear, a shaft decoupling, and/or a shaft failure in a gas turbine engine comprising a first spool and a second spool different from the first spool. First and second parameters indicative of the power of the first spool and a load transfer through a shaft of the second spool are obtained. A detection threshold is determined as a function of the first parameter. The second parameter is compared to the detection threshold. The shaft event is detected when the second parameter is beyond the detection threshold and then a signal indicative of the shaft event is transmitted.

18 Claims, 5 Drawing Sheets

SHAFT SHEAR DETECTION IN A GAS TURBINE ENGINE

TECHNICAL FIELD

The disclosure relates generally to shaft shear detection and, more particularly, to detecting shaft shears of loaded, rotating shafts in gas turbine engines.

BACKGROUND OF THE ART

The low pressure shaft on an aircraft propulsion gas turbine engine connects the lower pressure turbine to the engine output, such as a propeller in the example of a turboprop, and transfers the power from the turbine to the propeller. The transferred power is then converted into thrust. During engine operation, the shaft experiences very high torsional loads. In the unlikely event of a shaft shear and loss of load, the fuel should be shut off quickly to prevent damage to the engine.

Several methods exist for detecting shaft shear. However, these methods may not be well-suited for a process requiring rapid fuel shutoff. Moreover, methods that require special sensors or additional hardware may also have certain disadvantages, such as additional cost and weight, and/or give rise to durability and reliability concerns.

As such, there is a need for improvement.

SUMMARY

In one aspect, there is provided a method for detecting a shaft event in a gas turbine engine comprising a first spool and a second spool different from the first spool. The method comprises obtaining a first parameter indicative of one of power of the first spool and a load transfer through a shaft of the second spool, and obtaining a second parameter indicative of the other one of power of the first spool and the load transfer through the shaft of the second spool, determining a detection threshold as a function of the first parameter, comparing the second parameter to the detection threshold, and detecting the shaft event when the second parameter is beyond the detection threshold and then transmitting a signal indicative of the shaft event.

In another aspect, there is provided a system for detecting a shaft event in a gas turbine engine comprising a first spool and a second spool different from the first spool. The system comprises a processing unit and a non-transitory memory communicatively coupled to the processing unit. The memory has stored computer-readable program instructions executable by the processing unit for obtaining a first parameter indicative of one of power of the first spool and a load transfer through a shaft of the second spool, and obtaining a second parameter indicative of the other one of power of the first spool and the load transfer through the shaft of the second spool, determining a detection threshold as a function of the first parameter, comparing the second parameter to the detection threshold, and detecting the shaft event when the second parameter is beyond the detection threshold and then transmitting a signal indicative of the shaft event.

DESCRIPTION OF THE DRAWINGS

Reference is now made to the accompanying figures in which.

DETAILED DESCRIPTION

There is described herein methods and systems for detecting a shaft event, such as a shaft shear, a shaft decoupling, and/or a shaft failure in a gas turbine engine, using a relationship between a parameter indicative of power of a first spool of the engine and another parameter indicative of a load transfer through a shaft of a second spool of the engine. This relationship is used to determine a detection threshold for the detection of the shaft event.

Figure 1:
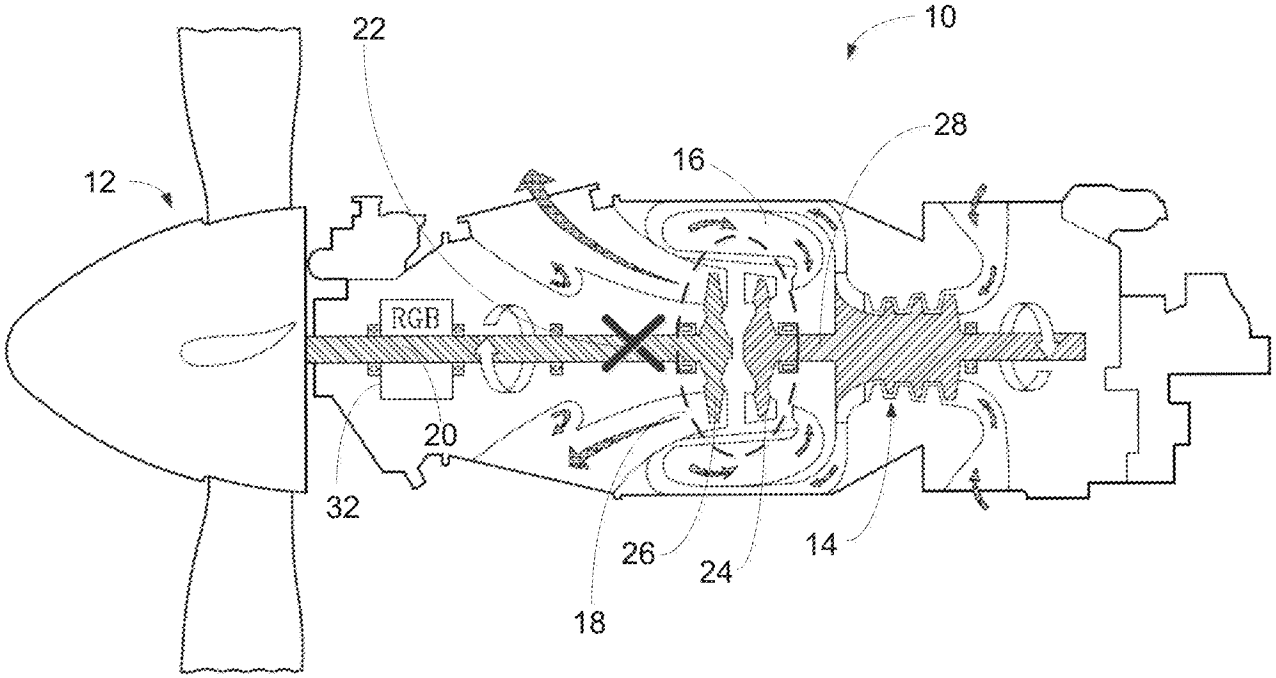
FIG. 1 is a schematic cross-sectional view of a gas turbine engine, in accordance with one or more embodiments.

FIG. 1 illustrates a gas turbine engine 10 for which a shaft event, such as a shaft shear, a shaft decoupling, or any other type of shaft failure, may be detected using the systems and methods described herein. Note that while engine 10 is a turboprop aircraft engine, the detection methods and systems described herein may also be applicable to turbofan engines, turboshaft engines and/or any other suitable engines. The detection methods and systems are applicable to engines having two or more spools.

Engine 10 generally comprises in serial flow communication a propeller 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. A low pressure spool is composed of a low pressure shaft 20 and a low pressure turbine 26. The low pressure shaft drives the propeller 12. A high pressure spool is composed of a high pressure turbine 24 attached to a high-pressure shaft 28, which is connected to the compressor section 14. A shaft event may occur and be detected at any point 22 along the low pressure shaft 20. In an engine configuration having three spools, namely a low pressure spool, a high pressure spool, and a power turbine spool, a shaft event may occur and be detected at any point along a low pressure shaft of the low pressure spool or a power turbine shaft of the power turbine spool.

The shaft event is detected using a relationship established between the parameter indicative of power of a first spool in the engine 10, such as the high pressure spool or the low pressure spool, and another parameter indicative of a load transfer through the shaft of a second spool different from the first spool. In some embodiments, the second spool is the low pressure spool, if the parameter indicative of power of the high pressure spool is used. In some embodiments, the second spool is the power turbine spool, if the parameter indicative of power of the high or low pressure spool is used. Accordingly, if the shaft event is to be detected on a shaft of a low pressure spool, then the parameter indicative of power of the high pressure spool and the parameter indicative of the load transfer through the low pressure shaft may be used. If the shaft event is to be detected on a shaft of a power turbine, then the parameter indicative of power of the high pressure spool or the low pressure spool may be used, and the parameter indicative of the load transfer through the power turbine shaft may be used.

Figure 2:
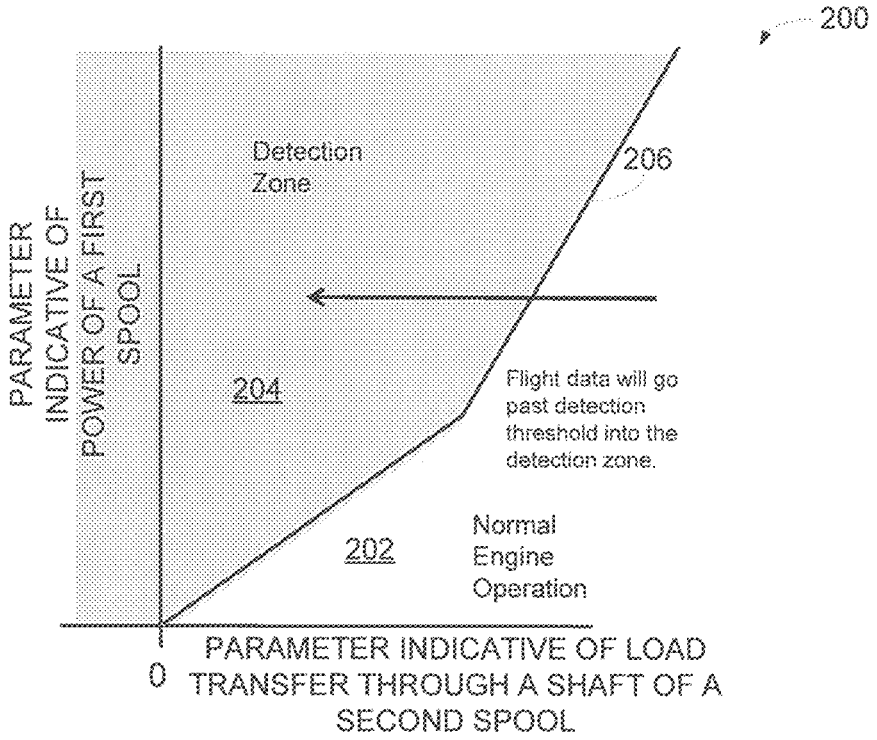
FIG. 2 is graphical illustration of the relationship between a parameter indicative of power of a first spool of the engine and load transfer through a shaft of a second spool of the engine, in accordance with one or more embodiments.

This relationship is illustrated graphically in FIG. 2, through graph 200. The y-axis of graph 200 represents the parameter indicative of power of the first spool. The parameter indicative of power may be a discharge pressure of the compressor 14 of the engine 10, a fuel flow to the combustor 16 of the engine 10 or a core airflow through the first spool of the engine 10 (e.g., the low or high pressure spool). The parameter indicative of power may be obtained by measuring the compressor discharge pressure, the fuel flow or the core airflow. One or more sensors placed in the engine 10 may be used to measure the compressor discharge pressure, the fuel flow or the core airflow. The compressor discharge pressure may be obtained by a measuring device that comprises one or more sensors for measuring gas pressure. The measuring device for measuring the compressor discharge pressure may be a pressure sensor, a pressure transducer, a pressure transmitter or any other suitable device. The fuel flow may be obtained by a measuring device, such as a fuel flow meter, which may measures a volume of fluid passing through the meter over a rate of time. A turbine flow meter or a coriolis flow meter may be used. The core airflow may be obtained from a gas flow meter placed within the engine 10. The core airflow may be estimated based on the measurements obtained from the gas flow meter. The core airflow may be determined based on ambient temperature, compressor discharge pressure and/or compressor speed, which may be obtained from one or more sensors. In some embodiments, the methods and systems for detecting a shaft event make use of existing sensors and/or sensor readings already provided in most engines, such as engine 10, in order to obtain the parameter indicative of power. In some embodiments, the parameter indicative of power may be provided by an engine controller or computer that determines the parameter indicative of power.

The x-axis of the graph 200 represents a load transfer through a shaft of the second spool, such as the low pressure shaft 20 of the low pressure spool or the power turbine shaft of the power turbine spool. The load transfer may be turbine torque of the second spool, horsepower of the shaft of the second spool, a twist angle of the shaft of the second spool, a deflection or distance measurement of the shaft of the second spool, a load or force measurement of the shaft of the second spool, or a stress or strain measurement of the shaft of the second spool.

In some embodiments, the load transfer is the measurable change of load borne by the low pressure shaft 20 during acceleration and deceleration (both longitudinal and lateral) of the low pressure spool. One or more moments are generated during acceleration/deceleration that cause variation in the load distributed on the low pressure shaft 20. It is this variation that may be measured as the load transfer. The load transfer may be measured using various parameters, such as the torque of low pressure turbine 26, the horsepower of low pressure shaft 20, and the twist angle of low pressure shaft 20. Any of these parameters may be measured using a torque sensor, which may be provided in a reduction gearbox (RGB) 32 in engine 10, or at any other location proximal to the low pressure shaft 20.

In some embodiments, the load transfer is measured using a deflection or distance measurement, for example using reference points placed on a torque tube or a reference tube. When a load is transmitted through the low pressure shaft 20, the distance between the reference points will increase or decrease proportionally to the load transmitted through the shaft. In other embodiments, the load transfer is measured using a load or force from a load cell, or using a stress or strain from a strain gauge. The strain gauge may be placed on the low pressure shaft 20. In other embodiments, the strain gauge voltage is used as a measurement that is proportional to the load transmitted through the shaft 20. Any other parameter that is indicative of load transfer through the shaft 20 may also be used.

The load transfer of the power turbine shaft of the power turbine spool may be measured in a similar manner to that described in relation to measuring the load transfer of the low pressure shaft 20 of the low pressure spool. In some embodiments, the load transfer can be measured using a torque meter that reads a phase difference between two shafts that are in the load path. In some embodiments, the load transfer can be obtained by measuring a deflection or distance between two shaft. The deflection or distance may then be used to determine torque. In some embodiments, the load transfer can be obtained from a strain gauge used to obtain a load measurement. The load measurement may then be used to determine torque.

Graph 200 is separated into a normal engine operation zone 202 and a shaft event zone 204. The zones 202, 204 are separated by a detection threshold 206. Under normal operation, measured values for the parameter indicative of power and the load transfer fall in the normal operation zone 202, which is to the right of the detection threshold 206 in the particular example shown in graph 200. If the x and y axes of the graph 200 were inverted, then the normal operation zone 202 would be above the detection threshold 206 and the shaft event zone 204 would be below the detection threshold. For example, in the event of a shaft shear or other shaft failure of the low pressure shaft 20, the parameter indicative of power of high pressure spool remains high but the parameter indicative of the load transfer quickly drops toward zero, thus moving from the normal engine operation zone 202 past the detection threshold 206 and into the shaft event zone 204. Therefore, when the parameter indicative of the load transfer and corresponding parameter indicative of power is mapped into the shaft event zone 204, a shaft event is detected.

The detection threshold 206 may be determined through testing and/or via computer simulations. Detection thresholds may be determined using flight test data for various conditions and manoeuvres, such as acceleration, deceleration, landing, reverse thrust, handling manoeuvres, flameouts, windmilling, and the like. Data may also be gathered for different flight conditions, and different detection thresholds may be established for each flight condition.

In some embodiments, the detection threshold 206 is engine model specific or engine condition specific. For example, detection threshold 206 may vary as a function of certain engine characteristics, such as ambient pressure. The detection threshold may therefore vary for a same first parameter indicative of power of a first spool for different ambient pressures. In addition, engine acceleration/deceleration capabilities may also have an impact on the detection threshold. In some embodiments, the detection threshold 206 varies as a function of flight conditions, such as airspeed and/or atmospheric conditions. The detection threshold may vary throughout the flight envelope. For example, the detection threshold may be stored in tabular form, as a function of a variable parameter that depends on the flight envelope of the aircraft, such as ambient pressure.

In some embodiments, the detection thresholds are modified or adjusted to prevent false detection due to various non-shaft events, such as ice/hail stone ingestion, ice sheet ingestion, bird ingestion, fuel flow runaway event, feathering/unfeathering of the propeller, flameout, surge events, and the like.

In some embodiments, negative load transfer values are not used for detecting the shaft event. For example, detection logic may be shut off below a certain power level of the engine to ensure only positive values are measured and/or only turned on above a certain power level. Alternatively, a different detection threshold may be used for negative load transfer values.

Figure 3:
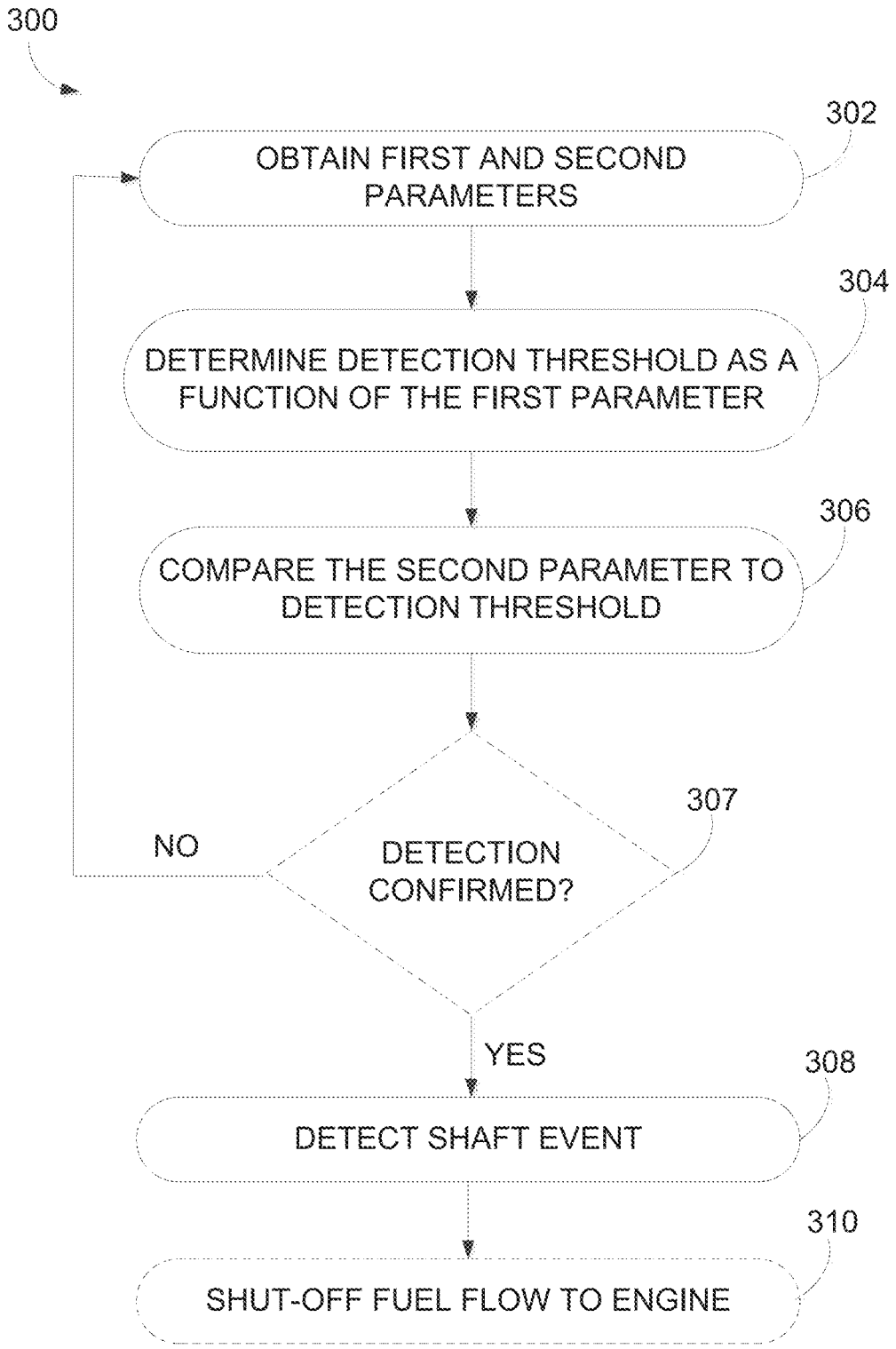
FIG. 3 is a flowchart of a shaft event detection method, in accordance with one or more embodiments.

Referring to FIG. 3, there is illustrated a flowchart of an example method 300 for detecting a shaft event. At step 302, a first parameter and a second parameter are obtained during engine operation. The first parameter may be indicative of one of the power of the first spool and the load transfer through a shaft of the second spool. The second parameter may be indicative of the other one of power of the first spool and the load transfer through the shaft of the second spool. For example, if the first parameter is indicative of power of the first spool, then the second parameter is indicative of load transfer through the shaft of the second spool. The obtained first and second parameters are operation values for the parameters indicative of power and/or the load transfer. Step 302 may comprise performing the measurements for the parameters indicative of power and/or the load transfer during engine operation. Alternatively, this may include simply receiving the measurements for the parameters indicative of power and/or the load transfer. Obtaining the first and second parameters may comprises measuring the load transfer through a low pressure shaft or comprises measuring the load transfer through a power turbine shaft. Alternatively, in some embodiments, the first parameter is indicative of power of the first spool and the second parameter is indicative of power of the second spool.

At step 304, the detection threshold is determined as a function of at least the first parameter. The detection threshold may be a threshold value. For example, if the first parameter is indicative of power, then the detection threshold may be a load transfer value beyond which a shaft event is detected. If the first parameter is indicative of the load transfer, then the detection threshold may be a value for the parameter indicative of power beyond which a shaft event is detected. In some embodiments, determining the detection threshold comprises retrieving the detection threshold from memory. In some embodiments, determining the detection threshold comprises receiving the first parameter and obtaining the detection threshold from memory based on the received first parameter. In some embodiments, determining the detection threshold comprises storing the detection threshold in memory. Determining the detection threshold may comprise setting or generating the detection threshold as a function of various input parameters, such as engine characteristics, flight conditions, engine operating conditions, and other data.

In some embodiments, the detection threshold comprises a plurality of threshold values for the second parameter for each value of the first parameter. In some embodiments, the detection threshold may be determined as a set of threshold values for the first and second parameter, and defines for each value for the first parameter, a value for the second parameter beyond which a shaft event is detected. In some embodiments, determining the detection threshold comprises receiving pairs of operation values for the first and second parameter throughout a flight envelope that fall into either one of the two detection zones, namely the normal engine operation zone and the shaft event zone.

At step 306, at least the second parameter is compared to the detection threshold. If the second parameter is beyond the detection threshold, a shaft event is detected, as per step 308. If the second parameter is not beyond the detection threshold, no shaft event may be identified and the method 300 may return to step 302, followed by step 304, and followed by step 306.

In some embodiments, at step 306, the second parameter is compared to the determined threshold value and if the second parameter is beyond the threshold value, a shaft event is detected, as per step 308. If the second parameter is not beyond the threshold value, no shaft event may be identified and the method 300 may return to step 302, followed by step 304, and followed by step 306.

In some embodiments, at step 306, the pair of operation values for the first and second parameter are compared to the detection threshold comprising the plurality of threshold values for the second parameter for each value of the first parameter and if the operation values are beyond the detection threshold, a shaft event is detected, as per step 308. If the operation values are not beyond the detection threshold, no shaft event may be identified and the method 300 may return to step 302, followed by step 304, and followed by step 306. Comparing the operation values to the detection threshold may comprise comparing the operation value for the parameter indicative of power to the threshold value for the parameter indicative of power and comparing the operation value for the parameter indicative of the load transfer to the threshold value for the parameter indicative of the load transfer. This comparison of the operation values to the threshold values may be done to determine which one of the two detection zones, namely the normal engine operation zone and the shaft event zone, that the operation values fall therein.

In some embodiments, a shaft event is detected only after a predetermined number of iterations where the second parameter moves past the threshold value or the operation values move past the detection threshold into the shaft event zone. For example, the number of required iterations may be set to 2, 5, 10, or any other value used to satisfy a criteria for confirming the measurement. In such embodiments, a counter may be set to an initial value and incremented until the counter value is equal to or greater than the number of required iterations. This may be done, for example, when confirming detection at step 307 after step 306.

In some embodiments, a shaft event is detected only after the second parameter is beyond the threshold value or the operation values are beyond the detection threshold for a predetermined period of time. In such embodiments, a timer may be initiated when the second parameter initially moves past the threshold value or the operation values initially moves past the detection threshold into the shaft event zone and the shaft event is detected after the timer exceeds the predetermined period of time. The timer would reset if the second parameter moves below the threshold value or the operation values move below the detection threshold into the normal operation zone. This may be done, for example, when confirming detection at step 307 after step 306.

In some embodiments, step 308 of detecting the shaft event comprises transmitting a signal indicative of the shaft event. The signal may be used to shut-off the fuel flow to the engine, as per step 310. For example, the signal may be transmitted to one or more fuel flow valves to turn off a fuel flow to the engine 10. Alternatively, or in combination therewith, detecting the shaft event comprises triggering a warning, such as a light or a text message in an aircraft cockpit or elsewhere, indicative of the shaft event. For example, the signal may be transmitted to a display device to display an alert of the shaft event or transmitted to an aircraft computer communicatively coupled to a display device to cause the display device to display an alert of the shaft event. Other embodiments for actions resulting from the detected shaft event may also be used.

Figure 4:
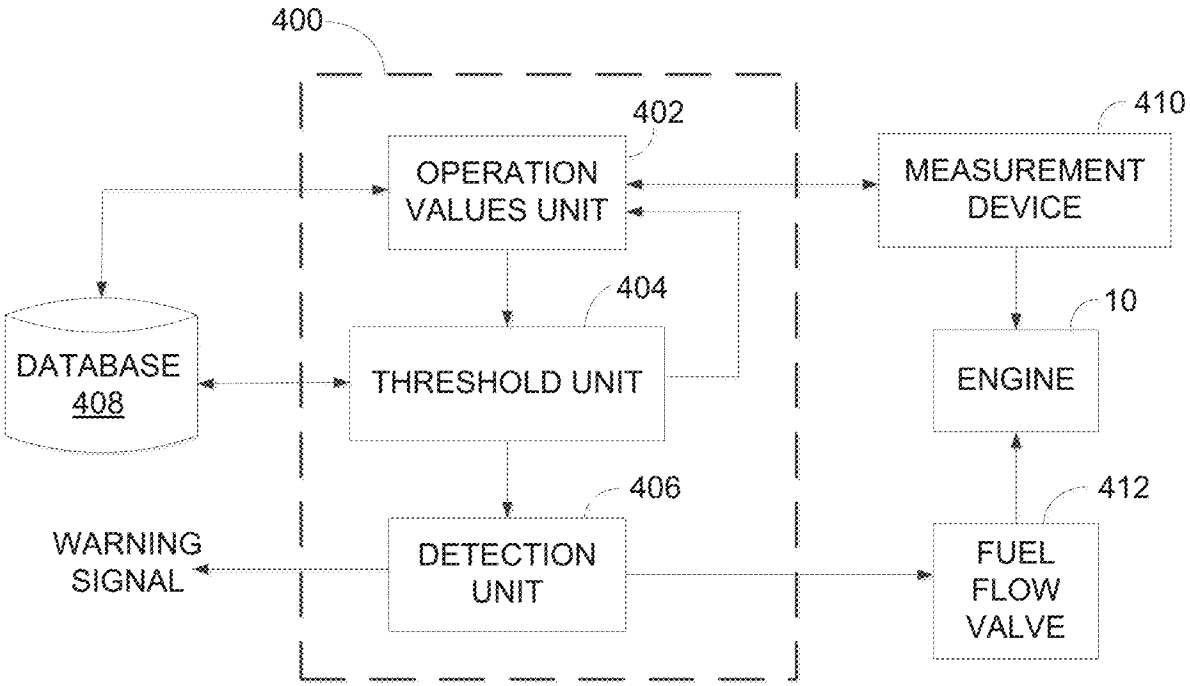
FIG. 4 is an example embodiment of a shaft event detection system, in accordance with one or more embodiments.

FIG. 4 illustrates an exemplary embodiment of a detection system 400 for detecting the shaft event. The system 400 illustratively comprises an operation values unit 402, a threshold unit 404, and a detection unit 406. The operation values unit may be configured to obtain the operation values for the first and second parameter, by receiving the operation values or retrieving the operation values from a local or remote storage medium, such as database 408. In some embodiments, the operation values unit 402 is operatively coupled to one or more measurement device 410 such as a sensor or a probe, which is itself coupled to the engine 10, and receives measurements directly therefrom. In some embodiments, the operation values unit 402 is configured for controlling the measurement device 410 so as to cause the measurements to be acquired. Various data processing operations may be performed on the received measurements by the operation values unit 402, such as averaging, filtering, fault detection, and the like.

Once received, the operation values are provided to the threshold unit 404. One or more of the operation values are used to determine the detection threshold. The detection threshold may be retrieved or received from a local or remote storage medium, such as database 408. In some embodiments, the threshold unit 404 or the operation values unit 402 may be configured to receive various parameters and to generate the detection threshold for comparison with one or more of the operation values as a function of the received parameters. The operation values unit 402 or the threshold unit 404 may be configured to retrieve engine specific parameters, for example from database 408, in order to generate the detection threshold using detection threshold specifications. The result of the comparison is transmitted to the detection unit 406, which may be configured to transmit a fuel shutoff command to one or more engine fuel flow valve 412. The detection unit 406 may also be configured to transmit a warning signal, for example to the aircraft cockpit or externally to the aircraft, in case of a shaft event.

In some embodiment, there may be a feedback loop between the threshold unit 404 the operation values unit 402 in order to increment a counter, and the shaft event is only detected when the counter reaches a predetermined number.

The detection system 400 may be implemented in various manners, such as in software on a processor, on a programmable chip, on an Application Specific Integrated Chip (ASIC), or as a hardware circuit. In some embodiments, the detection system 400 is implemented in hardware on a dedicated circuit board located inside an Electronic Engine Controller (EEC) or an Engine Control Unit (ECU). The EEC or ECU may be provided as part of a Full Authority Digital Engine Control (FADEC) of an aircraft. In some cases, a processor may be used to communicate information to the circuit, such as the parameter indicative of power and/or the load transfer. In other embodiments, the detection system 400 is implemented in a digital processor. In some embodiments, the FADEC performs the shutdown of the fuel once a shaft event has been detected.

Figure 5:
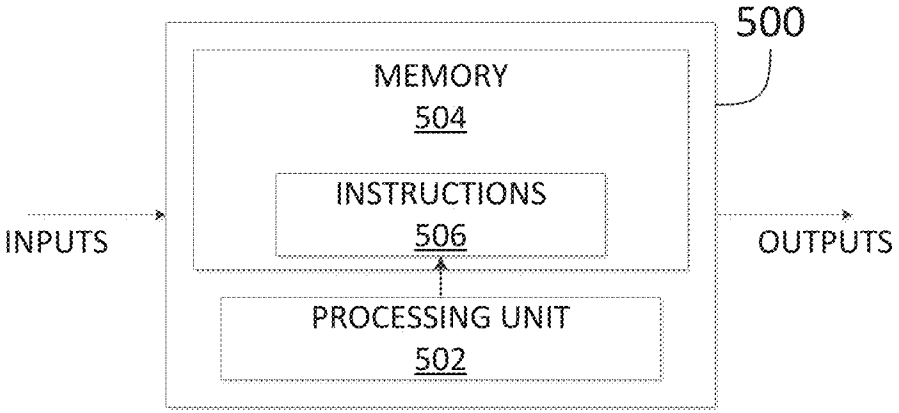
FIG. 5 is an example computing device for implementing the shaft event detection method and/or the shaft event detection system, in accordance with one or more embodiments.

The system 400 may be implemented by the computing device 500 illustrated in FIG. 5. The computing device 500 may comprise, amongst other things, a processing unit 502 and a memory 504 which has stored therein computer-executable instructions 506. The processing unit 502 may comprise any suitable devices configured to cause a series of steps to be performed so as to implement the method 300 such that instructions 506, when executed by the computing device 500 or other programmable apparatus, may cause the functions/acts/steps specified in the methods described herein to be executed. The processing unit 502 may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory 504 may comprise any suitable machine-readable storage medium. The memory 504 may comprise non-transitory computer readable storage medium such as, for example, but not limited to, an electronic, magnetic, optical, electromagnetic, infrared, or semiconductor system, apparatus, or device, or any suitable combination of the foregoing. The memory 504 may include a suitable combination of any type of computer memory that is located either internally or externally to device 500, such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. Memory may comprise any storage means (e.g., devices) suitable for retrievably storing machine-readable instructions executable by processing unit.

In some embodiments, the computing device 500 sends one or more control signals directly to fuel valves for shutting off the engine fuel flow. In other embodiments, the control signals are sent to an intermediary unit (not shown), which translates the control signals sent by the computing device 500 into signals to be sent to the fuel valves.

The methods and systems for detecting the shaft event described herein may be implemented in a high level procedural or object oriented programming or scripting language, or a combination thereof, to communicate with or assist in the operation of a computer system, for example the computing device 500. Alternatively, the methods and systems for detecting the shaft event may be implemented in assembly or machine language. The language may be a compiled or interpreted language. Program code for implementing the methods and systems for detecting the shaft event may be stored on a storage media or a device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein. Embodiments of the methods and systems for detecting the shaft event may also be considered to be implemented by way of a non-transitory computer-readable storage medium having a computer program stored thereon. The computer program may comprise computer-readable instructions which cause a computer, or more specifically the processing unit 502 of the computing device 500, to operate in a specific and predefined manner to perform the functions described herein.

Computer-executable instructions may be in many forms, including program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments.

Various aspects of the methods and systems for detecting the shaft event may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. Although particular embodiments have been shown and described, it will be obvious to those skilled in the art that changes and modifications may be made without departing from this invention in its broader aspects. The scope of the following claims should not be limited by the embodiments set forth in the examples, but should be given the broadest reasonable interpretation consistent with the description as a whole.

The invention claimed is:

1. A method for detecting a shaft event in a gas turbine engine comprising a first spool and a second spool different from the first spool, the method comprising:

obtaining a first parameter indicative of a load transfer through a shaft of the second spool, and obtaining a second parameter indicative of one of: a fuel flow to a combustor of the engine, or a core airflow through the first spool;

determining a detection threshold as a function of the first parameter;

comparing the second parameter to the detection threshold; and detecting the shaft event when the second parameter is beyond the detection threshold and then transmitting a signal indicative of the shaft event.

2. The method of claim 1, wherein the first spool is a high pressure spool and the second spool is a low pressure spool, and wherein obtaining the first parameter and the second parameter comprises measuring the load transfer through a low pressure shaft.

3. The method of claim 2, wherein measuring the load transfer comprises measuring the load transfer with a torque sensor in a gearbox of the engine.

4. The method of claim 2, wherein measuring the load transfer comprises measuring the load transfer with a strain gauge.

5. The method of claim 1, wherein the first spool is one of a high pressure spool and a low pressure spool, and the second spool is a power turbine spool, and wherein obtaining the first parameter and the second parameter comprises measuring the load transfer through a power turbine shaft.

6. The method of claim 1, wherein transmitting the signal comprises transmitting the signal to one or more fuel flow valves to turn off a fuel flow to the engine.

7. The method of claim 1, wherein transmitting the signal comprises transmitting the signal to a display device to display an alert of the shaft event.

8. The method of claim 1, wherein the detection threshold is engine specific and varies as a function of engine characteristics.

9. The method of claim 1, wherein the detection threshold varies as a function of flight conditions.

10. A system for detecting a shaft event in a gas turbine engine comprising a first spool and a second spool different from the first spool, the system comprising:

a processing unit; and a non-transitory memory communicatively coupled to the processing unit and comprising computer-readable program instructions executable by the processing unit for:

obtaining a first parameter indicative of a load transfer through a shaft of the second spool, and obtaining a second parameter indicative of one of: a fuel flow to a combustor of the engine, or a core airflow through the first spool;

determining a detection threshold as a function of the first parameter;

comparing the second parameter to the detection threshold; and detecting the shaft event when the second parameter is beyond the detection threshold and then transmitting a signal indicative of the shaft event.

11. The system of claim 10, wherein the first spool is a high pressure spool and the second spool is a low pressure spool, and wherein obtaining the first parameter and the second parameter comprises measuring the load transfer through a low pressure shaft.

12. The system of claim 10, wherein measuring the load transfer comprises measuring the load transfer with a torque sensor in a gearbox of the engine.

13. The system of claim 10, wherein measuring the load transfer comprises measuring the load transfer with a strain gauge.

14. The system of claim 10, wherein the first spool is one of a high pressure spool and a low pressure spool, and the second spool is a power turbine spool, and wherein obtaining the first parameter and the second parameter comprises measuring the load transfer through a power turbine shaft.

15. The system of claim 10, wherein transmitting the signal comprises transmitting the signal to one or more fuel flow valves to turn off a fuel flow to the engine.

16. The system of claim 10, wherein transmitting the signal comprises transmitting the signal to a display device to display an alert of the shaft event.

17. The system of claim 10, wherein the detection threshold is engine specific and varies as a function of engine characteristics.

18. The system of claim 10, wherein the detection threshold varies as a function of flight conditions.

* * * * *